US011218799B2

(12) United States Patent
Choi et al.

(10) Patent No.: US 11,218,799 B2
(45) Date of Patent: Jan. 4, 2022

(54) BUILT-IN SPEAKER MODULE

(71) Applicant: CERAGEM CO., LTD., Cheonan-si (KR)

(72) Inventors: Sang Ho Choi, Cheonan-si (KR); Jin Cheol Park, Cheonan-si (KR); Yong son Park, Anyang-si (KR); Dong Myoung Lee, Asan-si (KR); Yong Seob Seo, Cheonan-si (KR)

(73) Assignee: CERAGEM CO., LTD., Cheonan-si (KR)

( * ) Notice: Subject to any disclaimer, the term of this patent is extended or adjusted under 35 U.S.C. 154(b) by 0 days.

(21) Appl. No.: 17/089,294

(22) Filed: Nov. 4, 2020

(65) Prior Publication Data

US 2021/0136485 A1 May 6, 2021

(30) Foreign Application Priority Data

Nov. 5, 2019 (KR) ..... 10-2019-0139976

(51) Int. Cl.
*H04R 1/28* (2006.01)

(52) U.S. Cl.
CPC ..... *H04R 1/2888* (2013.01); *H04R 1/288* (2013.01); *H04R 1/2896* (2013.01); *H04R 2499/15* (2013.01)

(58) Field of Classification Search
CPC .... H04R 1/2876; H04R 1/288; H04R 1/2892; H04R 1/2896
See application file for complete search history.

(56) References Cited

U.S. PATENT DOCUMENTS

2020/0162809 A1* 5/2020 Honji ..... B60J 5/0463

FOREIGN PATENT DOCUMENTS

| | | | |
|---|---|---|---|
| KR | 20-1999-0008830 | U | 3/1999 |
| KR | 10-2009-0079527 | A | 7/2009 |
| KR | 10-2013-0043886 | A | 5/2013 |
| KR | 10-2017-0021728 | A | 2/2017 |
| WO | 2014/002156 | A1 | 1/2014 |

* cited by examiner

*Primary Examiner* — Kile O Blair
(74) *Attorney, Agent, or Firm* — Knobbe Martens Olson & Bear LLP

(57) ABSTRACT

Provided herein is a built-in speaker module. The built-in speaker module is installed in a housing of an electronic device having a first bottom surface spaced apart from a ground and a second bottom surface installed above the first bottom surface, and includes a speaker installed above the second bottom surface, a first vibration absorbing member interposed between the speaker and the second bottom surface, and a second vibration absorbing member interposed between the first bottom surface and the second bottom surface, wherein sound is emitted from the speaker through openings formed in the first bottom surface and the second bottom surface.

12 Claims, 5 Drawing Sheets

BUILT-IN SPEAKER MODULE

CROSS-REFERENCE TO RELATED APPLICATION

This application claims priority to and the benefit of Korean Patent Application No. 10-2019-0139976, filed on Nov. 5, 2019, the disclosure of which is incorporated herein by reference in its entirety.

BACKGROUND

1. Field

The present disclosure relates to a built-in speaker device.

2. Discussion of Related Art

Speakers are electrical and mechanical devices which transmit sound waves by vibrating air through front-rear vibrations of vibration parts. Generally, a speaker built in an electronic device is installed to be in contact with a housing of the electronic device. As a result, vibrations from the speaker may be transmitted to the housing of the electronic device and may have an effect on the housing thereof. Therefore, when the speaker is installed in the electronic device, a separate vibration absorbing member is required so as to attenuate a vibration transmitted to the housing.

The disclosure of this section is to provide background information relating to the invention. Applicant does not admit that any information contained in this section constitutes prior art.

SUMMARY

The present disclosure is directed to a built-in speaker module capable of absorbing a vibration transmitted from a speaker to a housing of an electronic device and smoothly emitting sound in a ground direction.

According to an aspect of the present invention, there is provided a built-in speaker module in a housing of an electronic device having a first bottom surface spaced apart from a ground and a second bottom surface installed above the first bottom surface, which includes a speaker installed above the second bottom surface, a first vibration absorbing member interposed between the speaker and the second bottom surface, and a second vibration absorbing member interposed between the first bottom surface and the second bottom surface, wherein sound is emitted from the speaker through openings formed in the first bottom surface and the second bottom surface.

At least one sound outlet may be formed in the first bottom surface.

A first hollow having a cross section of a shape corresponding to a sound emission part of the speaker may be formed in the second bottom surface.

A portion of the first hollow may be formed by a protrusion protruding from the second bottom surface toward the ground.

The first vibration absorbing member may be formed in an annular shape.

A stepped bump adjacent to the first vibration absorbing member may be formed on an upper surface of the second bottom surface.

A second hollow having a shape corresponding to the sound emission part of the speaker may be formed in the second vibration absorbing member.

The second vibration absorbing member may be formed in an annular shape.

A thickness of the second vibration absorbing member may be greater than a thickness of the first vibration absorbing member.

A second hollow having a shape corresponding to the sound emission part of the speaker may be formed in the second vibration absorbing member, and a portion of the second hollow may be formed to surround the protrusion.

The built-in speaker module may be installed in a body shape management device.

According to another aspect of the present invention, there is provided an electronic device in which a built-in speaker is installed, which includes a housing including a first bottom surface spaced apart from a ground and a second bottom surface installed above the first bottom surface, a speaker installed above the second bottom surface, a first vibration absorbing member interposed between the speaker and the second bottom surface, and a second vibration absorbing member interposed between the first bottom surface and the second bottom surface, wherein sound is emitted from the speaker through openings formed in the first bottom surface and the second bottom surface.

BRIEF DESCRIPTION OF THE DRAWINGS

The above and other aspects, features and advantages of the present invention will become more apparent to those skilled in the art by describing embodiments thereof in detail with reference to the accompanying drawings, in which.

DETAILED DESCRIPTION OF EMBODIMENTS

Figure 1:
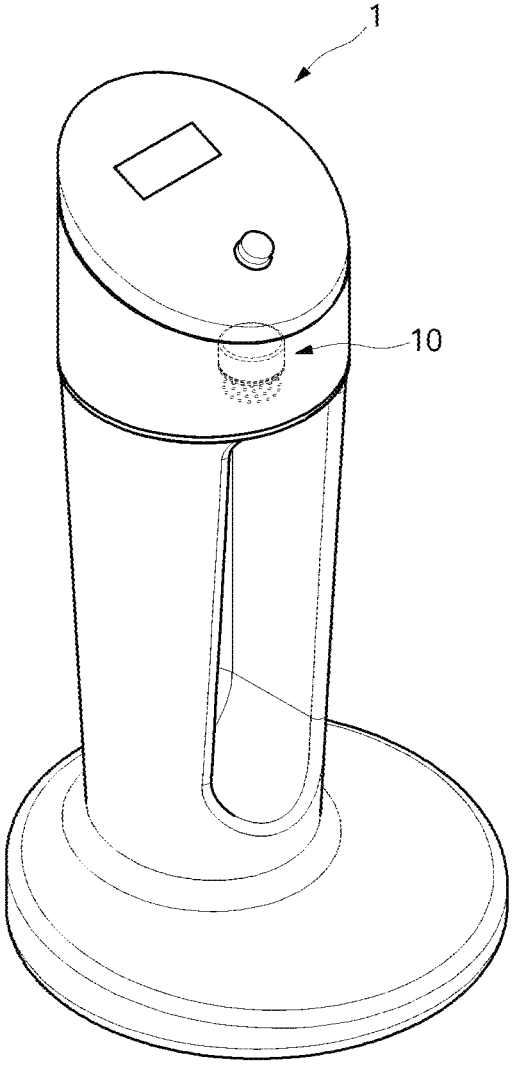
FIG. 1 is a perspective view illustrating an electronic device in which a built-in speaker module is installed according to one embodiment of the present invention.

Hereinafter, embodiments of the present invention will be fully described in detail which is suitable for easy implementation by those skilled in the art with reference to the accompanying drawings. The present invention may be implemented in various different forms, and thus it is not limited to embodiments which will be described herein. In the drawings, some portions not related to the description will be omitted herein and not shown in order to clearly describe the embodiments of present invention, and the same or similar reference numerals are given to the same components throughout this disclosure.

In this disclosure, the terms "comprising," "including," "having," or the like are used to specify that a feature, a number, a step, an operation, a component, an element, or a combination thereof described herein exists, and it should be understood that they do not preclude a probability of the presence or addition of one or more other features, numbers, steps, operations, components, elements, or combinations thereof in advance.

Owing to a characteristic of a structure of a speaker built in the housing, sound loss may occur in a process of emitting sound to the outside of the housing. In order to minimize the above loss, a sound guide member may be also required.

However, as members are added, a process of assembling an electronic device becomes more complicated, and a manufacturing production cost of the electronic device is increased. There is a need to develop a member for performing a complex function so as to minimize an addition of a separate member while addressing the foregoing that my occur from the speaker built in the housing of the electronic device.

Figure 2:
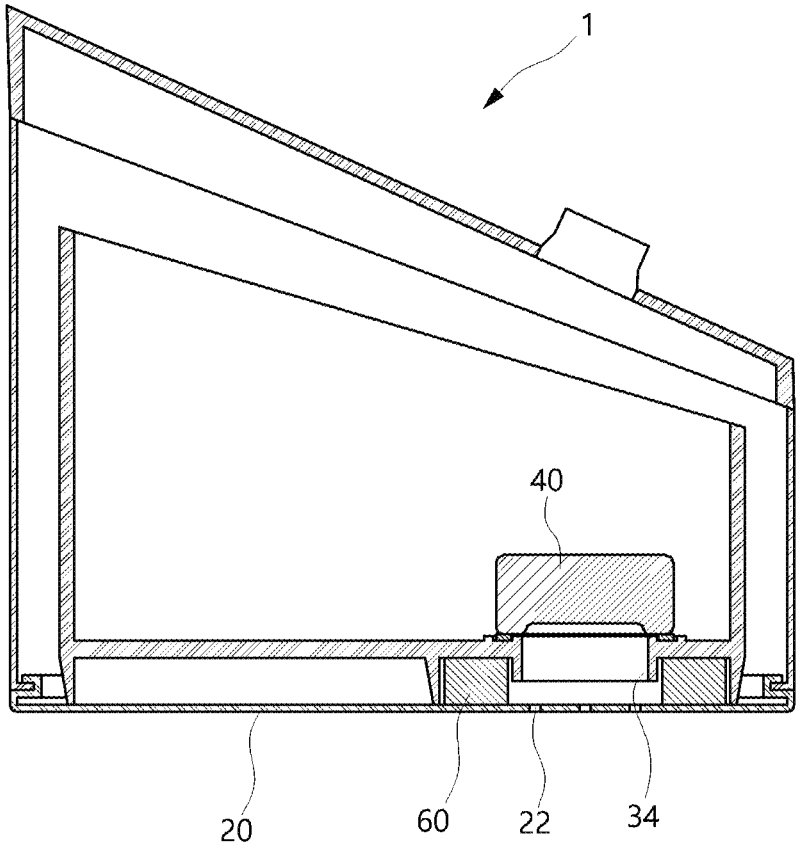
FIG. 2 is a cross-sectional view illustrating the electronic device in which the built-in speaker module is installed according to one embodiment of the present invention.

FIG. 1 is a perspective view illustrating an electronic device in which a built-in speaker module 10 is installed according to one embodiment of the present invention. FIG. 2 is a cross-sectional view illustrating the electronic device in which the built-in speaker module 10 is installed according to one embodiment of the present invention.

The built-in speaker module 10 according to one embodiment of the present invention is installed in an inner space of an electronic device 1. The electronic device 1 may be operated by receiving power and may be a device requiring a sound device such as a speaker. For example, the electronic device 1 may be a body shape management device or a low-frequency treatment device. Thus, a user using the electronic device 1 with the built-in speaker module 10 according to one embodiment of the present invention may focus on body shape management or low-frequency treatment without feeling bored.

In one embodiment of the present invention, the built-in speaker module 10 may be disposed adjacent to a first bottom surface 20 of the electronic device 1. In this case, referring to FIG. 1, the first bottom surface 20 of the electronic device 1 may be spaced apart from a ground so as to allow sound emitted from a speaker 40 to easily propagate through air. However, a position at which the built-in speaker module 10 according to one embodiment of the present invention is disposed is not limited thereto.

Meanwhile, an electric circuit, an operation part, or a display may be disposed on a top of the electronic device 1.

Figure 3:
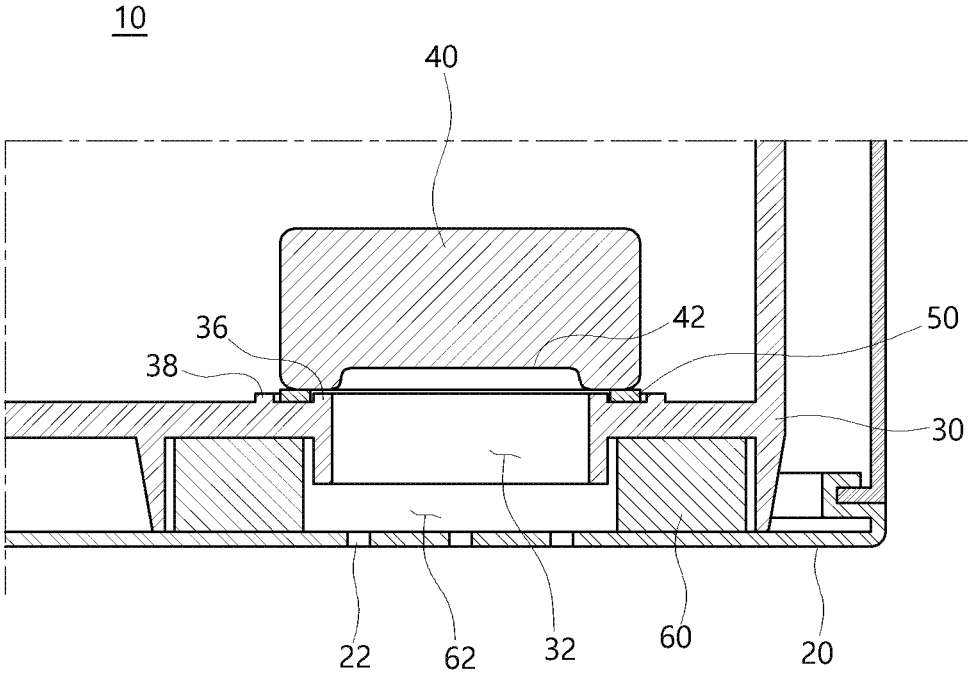
FIG. 3 is a cross-sectional view illustrating the built-in speaker module according to one embodiment of the present invention.
Figure 4:
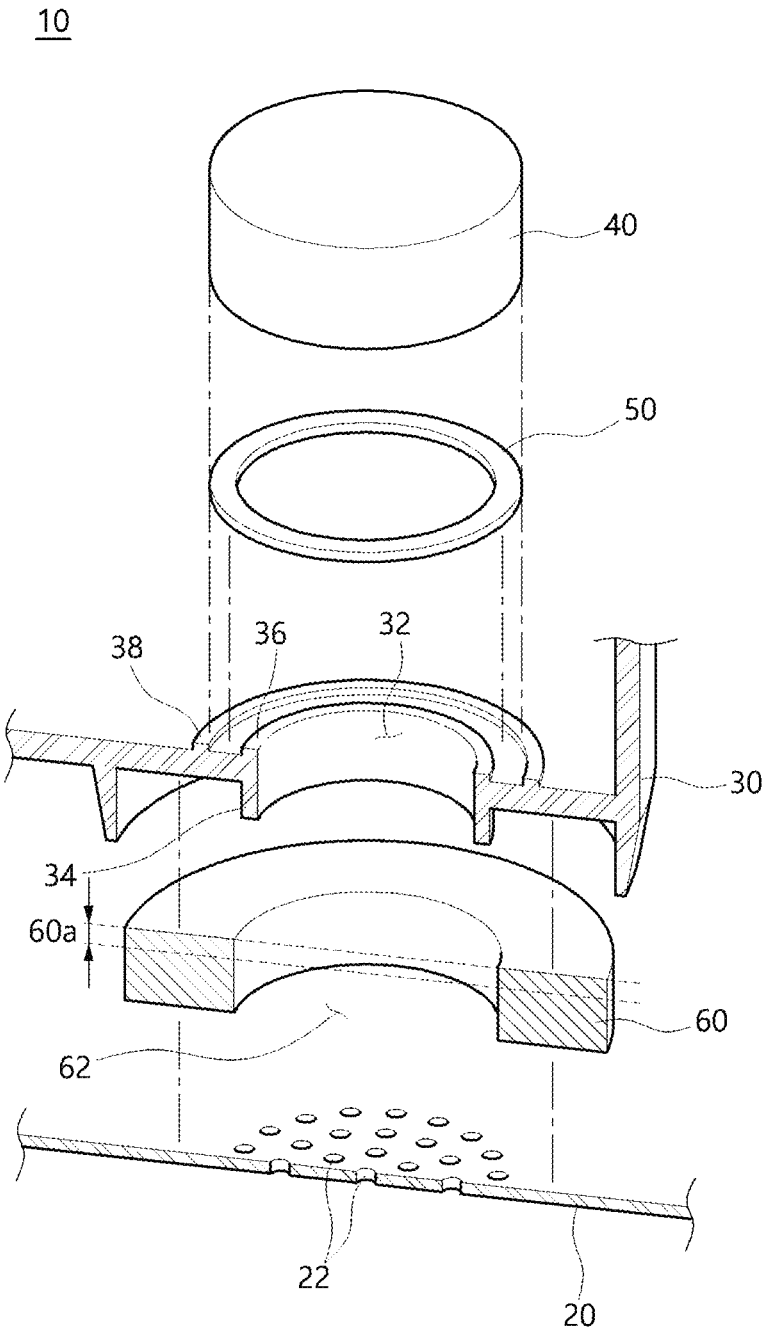
FIG. 4 is an exploded perspective view illustrating the built-in speaker module according to one embodiment of the present invention.
Figure 5:
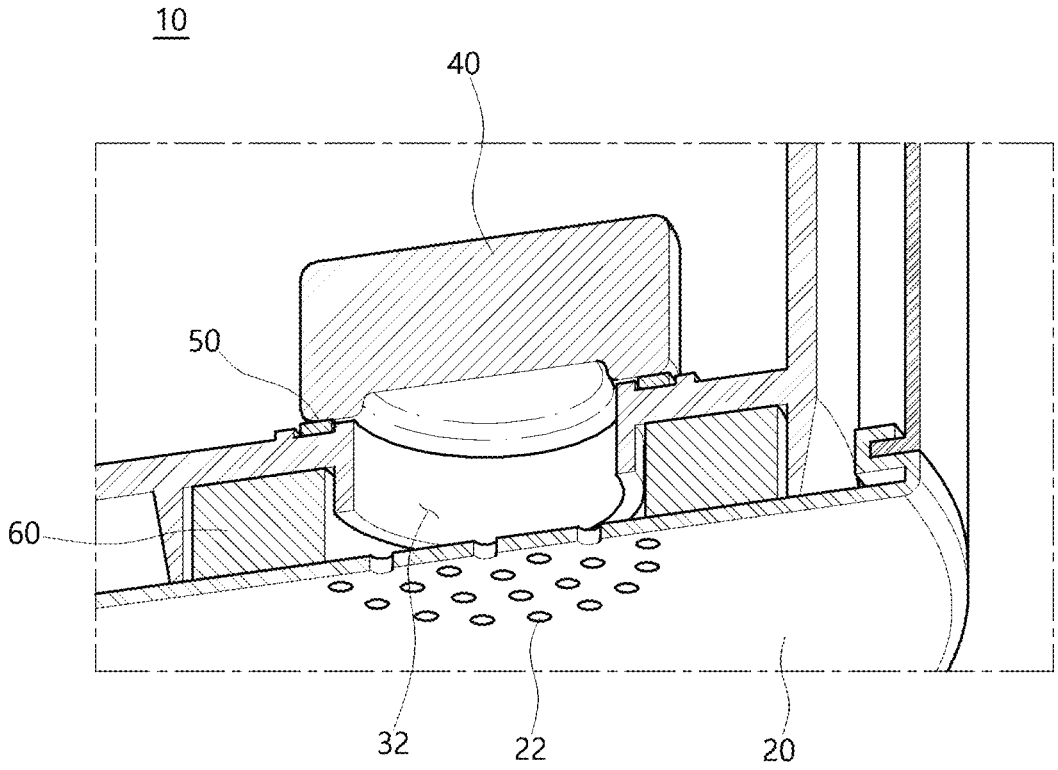
FIG. 5 is a transparent perspective view illustrating the electronic device in which the built-in speaker module is installed according to one embodiment of the present invention when viewed from below.

FIG. 3 is a cross-sectional view illustrating the built-in speaker module 10 according to one embodiment of the present invention. FIG. 4 is an exploded perspective view illustrating the built-in speaker module 10 according to one embodiment of the present invention. FIG. 5 is a transparent perspective view illustrating the electronic device 1 in which the built-in speaker module 10 is installed according to one embodiment of the present invention when viewed from below.

The built-in speaker module 10 according to one embodiment of the present invention is installed in an inner space of the electronic device 1 and is a module for attenuating transmission of a vibration due to installation of the speaker 40 to the electronic device 1 and for effectively emitting sound generated from the speaker 40 to the outside of the electronic device 1.

Referring to FIGS. 3 and 4, the built-in speaker module 10 according to one embodiment of the present invention includes the first bottom surface 20, a second bottom surface 30, the speaker 40, a first vibration absorbing member 50, and a second vibration absorbing member 60.

In one embodiment of the present invention, the first bottom surface 20 is a portion of a housing of the electronic device 1.

As shown in FIG. 3, the first bottom surface 20 is a bottom surface which is curved to extend from the bottom surface in contact with the ground and may be spaced a predetermined distance from the ground. In embodiments, the first bottom surface 20 may be located in midair. As described above, owing to a structure in which the first bottom surface 20 is located in midair, even when the built-in speaker module 10 is installed in a lower end of the electronic device 1, sound may propagate without disturbance of the ground.

In this case, referring to FIG. 5, at least one sound outlet 22 may be formed in the first bottom surface 20. As a result, the sound emitted from speaker 40 may pass through the first bottom surface 20 to be propagated into the air.

In this case, the sound outlet 22 may be formed in a fine size so as to emit the sound and prevent dust from being easily introduced. In embodiments, the sound outlet 22 is densely formed in a region corresponding to a sound emission part 42 of the speaker 40, which will be described below, in the first bottom surface 20.

The built-in speaker module 10 according to one embodiment of the present invention has a second bottom surface 30 which is spaced upward from the first bottom surface 20.

In this case, referring to FIG. 3, the second bottom surface 30 may extend from a sidewall of the electronic device 1 in a horizontal direction. In embodiments, the second bottom surface 30 extends parallel to the first bottom surface 20.

Referring to FIG. 3, a first hollow 32 which is an empty space present in the second bottom surface 30 may be formed in a portion of the second bottom surface 30.

In embodiments, a cross section of the first hollow 32 is formed in a shape corresponding to the sound emission part 42 of the speaker 40 which is disposed above the first hollow 32. For example, when the sound emission part 42 has a circular shape, the first hollow 32 may be formed in a cylindrical shape having a circular cross section. This is to minimize an area in contact with the first hollow 32 of the sound emitted from the sound emission part 42, thereby guiding the sound in a direction of the first bottom surface 20 without a loss.

Referring to FIG. 3 again, a portion of the first hollow 32 may be formed by a protrusion 34 protruding from the second bottom surface 30 in a ground direction.

More specifically, since an upper portion of the first hollow 32 is present in the second bottom surface 30, the upper portion of the first hollow 32 may be formed by a thickness surface of the second bottom surface 30, and a lower portion of the first hollow 32 may be formed by the protrusion 34 protruding from the second bottom surface 30 toward the ground. However, the first hollow 32 is not formed in a separate shape and is formed in one shape with a sense of unity. For example, the first hollow 32 may be formed in a cylindrical shape in which cross-sectional areas of an upper portion and a lower portion thereof are the same.

As described above, a height (or thickness) of the first hollow 32 becomes greater due to the protrusion 34 protruding toward the ground. Thus, the sound may be guided more effectively to the first bottom surface 20. In addition, since the protrusion 34 is in contact with a second hollow 62, a horizontal movement of the second vibration absorbing member 60, which will be described below, may be limited. This will be described in more detail in a description of the second vibration absorbing member 60.

In addition, stepped bumps 36 and 38 protruding in a direction opposite to the ground may be formed in an area adjacent to the first hollow 32 on the upper surface of the second bottom surface 30.

In embodiments, the stepped bumps 36 and 38 are each formed in a shape corresponding to a shape of the first vibration absorbing member 50 which will be described below. For example, when the first vibration absorbing member 50 is formed in an annular shape, the stepped bumps 36 and 38 are also each formed in an annular shape. This is to limit a horizontal movement of the first vibration absorbing member 50 which is to be disposed in an area adjacent to the first hollow 32. More detailed descriptions of the stepped bumps 36 and 38 will be made in a description of the first vibration absorbing member 50.

The speaker 40 of the built-in speaker module 10 according to one embodiment of the present invention may be installed above the second bottom surface 30.

In this case, the speaker 40 may be supported on the first vibration absorbing member 50, which will be described below, and alternatively, may be fixed to the second bottom surface 30 by a separate fixing part.

In one embodiment of the present invention, the speaker 40 may be a general speaker, and sound may be emitted through the sound emission part 42 formed in a lower surface of the speaker 40. As described above, the sound output through the sound emission part 42 may be transmitted to the outside through the sound outlet 22 of the first bottom surface 20 via the above described first hollow 32.

When the sound is output, the speaker 40 may generate a vibration. In this case, in order to prevent the vibration from being transmitted to the electronic device 1, the built-in speaker module 10 according to one embodiment of the present invention includes the first vibration absorbing member 50 and the second vibration absorbing member 60.

First, the first vibration absorbing member 50 is interposed between the second bottom surface 30 and the speaker 40. In embodiments, the first vibration absorbing member 50 is disposed on the upper surface of the second bottom surface 30 and is in direct contact with the second bottom surface 30 and the speaker 40.

In addition, in order to limit the horizontal movement of the first vibration absorbing member 50, the first vibration absorbing member 50 is disposed adjacent to the above described stepped bumps 36 and 38. In embodiments, as shown in FIG. 3, the first stepped bump 36 and the second stepped bump 38 are formed with the first vibration absorbing member 50 disposed therebetween, and the first vibration absorbing member 50 is disposed between the first and second stepped bumps 36 and 38.

The first vibration absorbing member 50 may be formed in a shape corresponding to a shape of the first hollow 32 in an area adjacent to the first hollow 32. For example, when the first hollow 32 is formed in a circular shape, the first vibration absorbing member 50 may be formed in an annular shape surrounding the first hollow 32.

In one embodiment of the present invention, the first vibration absorbing member 50 may be formed of a material having elasticity, such as ethylene-vinyl acetate (EVA) foam, urethane, or silicone. Accordingly, the first vibration absorbing member 50 may be disposed between the speaker 40 and the second bottom surface 30 to primarily absorb a vibration generated from the speaker 40.

In one embodiment of the present invention, the second vibration absorbing member 60 is interposed between the first bottom surface 20 and the second bottom surface 30.

In this case, like the first vibration absorbing member 50, the second vibration absorbing member 60 may be formed of a material having elasticity. Consequently, the second vibration absorbing member 60 may secondarily absorb a vibration, which is not sufficiently absorbed through the first vibration absorbing member 50, among vibrations generated by the speaker 40. As a result, an influence of the vibrations on the electronic device 1 is reduced so that durability of the electronic device 1 may be improved.

The second hollow 62, which may be used as a propagating path for the sound emitted from the speaker 40, may be formed in the second vibration absorbing member 60.

The second hollow 62 communicates with the first hollow 32 which is located thereabove. In embodiments, like the first hollow 32, a cross section of the second hollow 62 is also formed in the shape corresponding to the sound emission part 42 of the speaker 40. This is to prevent a sound loss by minimizing a contact area of the sound when the sound emitted from the sound emission part 42 passes sequentially through the first hollow 32 and the second hollow 62.

Referring to FIG. 4, the second vibration absorbing member 60 may be formed in an annular shape.

More specifically, the second hollow 62 formed in the second vibration absorbing member 60 may be formed in a cylindrical shape, and the second vibration absorbing member 60 may be formed in a ring shape surrounding the second hollow 62. As described above, since the second vibration absorbing member 60 is formed in a ring shape with no corners, the second vibration absorbing member 60 may be easily manufactured.

In this case, an upper portion 60*a* of the second vibration absorbing member 60 may be formed to surround the protrusion 34 which forms the first hollow 32. As shown in FIG. 3, in embodiments, the protrusion 34 and the upper portion 60*a* of the second vibration absorbing member 60 are disposed to overlap partially so that the protrusion 34 may be present between the first hollow 32 and the second hollow 62. As described above, this is to limit a horizontal movement of the second vibration absorbing member 60 through the protrusion 34.

In embodiments, the second vibration absorbing member 60 is formed to have a height (or thickness) such that a space between the first bottom surface 20 and the second bottom surface 30 may be completely filled with the second vibration absorbing member 60 in a vertical direction. This is because, when a gap is present in the vertical direction, a vibration absorbing effect due to the second vibration absorbing member 60 may not be effective.

In embodiments, the height (or thickness) of the second vibration absorbing member 60 is formed to be greater than a thickness of the first vibration absorbing member 50. This is because a vertical gap between the first bottom surface 20 and the second bottom surface 30 may need to be completely filled with the second vibration absorbing member 60. In addition, this is because, since the second vibration absorbing member 60 may need to perform a function of guiding the sound toward the first bottom surface 20 through the second hollow 62 in addition to a function of absorbing a vibration, a thickness of a predetermined length may need to be secured for the above functions.

In one embodiment of the present invention, the second vibration absorbing member 60 may be formed of a material having elasticity capable of absorbing a physical shock and having strong resistance against an impact. For example, the second vibration absorbing member 60 may be formed of high foaming ethylene-propylene-diene monomer (EPDM) having excellent elasticity and excellent durability.

Hereinafter, a propagating path of sound emitted from the speaker 40 and a process of absorbing a vibration will be described with reference to the accompanying drawings.

Referring to FIGS. 3 and 4, the sound emitted through the sound emission part 42 of the speaker 40 is guided in the ground direction along the first hollow 32 formed in the second bottom surface 30. Thereafter, the sound passes through the protrusion 34 forming the lower portion of the first hollow 32 and then passes through the second hollow 62 formed in the second vibration absorbing member 60. Finally, the sound is emitted to the outside of the electronic device 1 through the plurality of sound outlets 22 formed in the first bottom surface 20. During the above sound emission process, the sound is guided through the first hollow 32 and the second hollow 62 to be emitted to the outside with a minimized loss. In addition, since a direction of the sound emission coincides with a direction of gravity, it is possible to minimize an inflow of dust from the outside to the inside of the electronic device 1.

Meanwhile, a vibration generated by the speaker 40 is primarily absorbed by the first vibration absorbing member 50 in contact with the lower surface of the speaker 40. The vibration not absorbed is propagated through the second bottom surface 30 in the ground direction and is finally absorbed by the second vibration absorbing member 60 disposed between the second bottom surface 30 and the first bottom surface 20. Through the above vibration absorption process, the vibration applied to the electronic device 1 may be reduced, and finally, durability of the electronic device 1 may be maintained.

As described above, the built-in speaker module 10 according to the embodiment of the present invention may vertically include the first vibration absorbing member 50 and the second vibration absorbing member 60, thereby serving to absorb the vibration and, simultaneously, serving as a guide to assist emission of the sound. In particular, the second vibration absorbing member 60 may absorb a vibration while guiding emission of sound. In embodiments, since a composite function is performed with only one member, it is possible to achieve simplification of a manufacturing process and reduction of a manufacturing unit cost.

A built-in speaker module according to the embodiments of the present invention includes a first vibration absorbing member and a second vibration absorbing member so that a vibration generated by a speaker can be absorbed and sound can be smoothly emitted through a bottom surface of an electronic product.

The built-in speaker module according to the embodiments of the present invention includes the second vibration absorbing member which simultaneously performs a function of absorbing a vibration and a function of guiding sound so that a manufacturing process of an electronic device can be simplified.

Although embodiments of the present invention have been described, the spirit of the present invention is not limited to the embodiments disclosed herein, and it should be understood that numerous other embodiments can be devised by those skilled in the art that will fall within the same spirit and scope of the present invention through addition, modification, deletion, supplement, and the like of a component, and also these other embodiments will fall within the spirit and scope of the present invention.

What is claimed is:

1. A built-in speaker module installed in a housing of an electronic device having a first bottom surface spaced apart from a ground and a second bottom surface installed above the first bottom surface, the built-in speaker module comprising:

a speaker installed above the second bottom surface;

a first vibration absorbing member interposed between the speaker and the second bottom surface; and a second vibration absorbing member interposed between the first bottom surface and the second bottom surface, wherein sound is emitted from the speaker through openings formed in the first bottom surface and the second bottom surface.

2. The built-in speaker module of claim 1, wherein at least one sound outlet is formed in the first bottom surface.

3. The built-in speaker module of claim 1, wherein a first hollow having a cross section of a shape corresponding to a sound emission part of the speaker is formed in the second bottom surface.

4. The built-in speaker module of claim 3, wherein a portion of the first hollow is formed by a protrusion protruding from the second bottom surface toward the ground.

5. The built-in speaker module of claim 4, wherein:

a second hollow having a shape corresponding to the sound emission part of the speaker is formed in the second vibration absorbing member; and a portion of the second hollow is formed to surround the protrusion.

6. The built-in speaker module of claim 1, wherein the first vibration absorbing member is formed in an annular shape.

7. The built-in speaker module of claim 1, wherein a stepped bump adjacent to the first vibration absorbing member is formed on an upper surface of the second bottom surface.

8. The built-in speaker module of claim 1, wherein a second hollow having a shape corresponding to a sound emission part of the speaker is formed in the second vibration absorbing member.

9. The built-in speaker module of claim 1, wherein the second vibration absorbing member is formed in an annular shape.

10. The built-in speaker module of claim 1, wherein a thickness of the second vibration absorbing member is greater than a thickness of the first vibration absorbing member.

11. The built-in speaker module of claim 1, wherein the built-in speaker module is installed in a body shape management device.

12. An electronic device in which a built-in speaker is installed, comprising:

a housing including a first bottom surface spaced apart from a ground and a second bottom surface installed above the first bottom surface;

a speaker installed above the second bottom surface;

a first vibration absorbing member interposed between the speaker and the second bottom surface; and a second vibration absorbing member interposed between the first bottom surface and the second bottom surface, wherein sound is emitted from the speaker through openings formed in the first bottom surface and the second bottom surface.

* * * * *